United States Patent [19]

Göransson

[11] 4,015,635

[45] Apr. 5, 1977

[54] TUBES FOR THE PRODUCTION OF CARRIER BAGS WITH LATERAL ACCORDION FOLDS

[75] Inventor: Pehr Gunnar Heine Göransson, Malmo, Sweden

[73] Assignee: Rottneros Bag System AB, Malmo, Sweden

[22] Filed: July 15, 1975

[21] Appl. No.: 596,000

[30] Foreign Application Priority Data

July 15, 1974 Switzerland ..... 9737/74

[52] U.S. Cl. ..... 138/119; 206/390; 229/55; 229/DIG. 11; 428/120; 428/167

[51] Int. Cl.[2] ..... F16L 11/10

[58] Field of Search ..... 428/167, 38, 192, 120; 206/390, 808; 229/55, 69, 53, DIG. 11; 138/119, 121, 128

[56] References Cited

UNITED STATES PATENTS

| | | | |
|---|---|---|---|
| 2,778,171 | 1/1957 | Taunton | 206/808 X |
| 2,785,720 | 3/1957 | Wikle | 229/55 X |
| 3,269,643 | 8/1966 | McDowell | 229/55 |
| 3,508,587 | 4/1970 | Mauch | 138/119 |
| 3,746,607 | 7/1973 | Harmon et al. | 428/167 |

*Primary Examiner*—Stephen P. Garbe
*Attorney, Agent, or Firm*—Eugene E. Geoffrey, Jr.

[57] ABSTRACT

A tube of weldable sheeting for the production of carrier bags comprises first and second tube wall portions extending longitudinally of the tube in circumferentially spaced relationship. Alternating ribs and bands, extending longitudinally of the tube form together each of the first and second tube wall portions, each of the ribs being of lesser width and greater thickness than each of the bands. Third and fourth tube wall portions extending longitudinally of the tube are integrally connected to the first and second tube wall portions so as to form a tubular formation together with the first and second tube wall portions, the third and fourth tube wall portions having a thickness corresponding approximately to ¼ of the sum total of the thicknesses of one of the ribs and one of the bands.

4 Claims, 3 Drawing Figures

FIG. 2

TUBES FOR THE PRODUCTION OF CARRIER BAGS WITH LATERAL ACCORDION FOLDS

The present invention relates to a tube of weldable sheeting material for the production of carrier bags with lateral accordion folds. In the flat-folded state, the tube has two edge portions comprising four layers of material produced by accordion folding, located over each other and substantially equal in thickness, and a central portion comprising two layers of material produced by the folding and located one over the other.

A prior art tube of the above-described type consists of a layer of material of uniform thickness throughout the entire tube. Consequently, when this type of tube is folded flat, the edge portions consisting of four layers of material will be twice as thick as the central portion which consists of two layers of material. A disadvantage occurs when such a tube is rolled up lengthwise into a roll, i.e., the tube roll becomes considerably thicker at the ends than in the middle, which entails great difficulties in handling the roll.

Another prior art tube of the above-described type consists of a material whose thickness varies such that the tube, when folded flat, displays uniform thickness throughout its entire width. This is achieved in that each of the two layers of material constituting the central portion of the tube is twice as thick as each of the four layers of material constituting the edge portion. A disadvantage associated with this type of tube is the relatively great consumption of material in the production of the tube.

The object of the present invention is, therefore, to provide a tube which obviates the above-mentioned disadvantages, that is to say, a tube which, when rolled up, results in a uniformly thick roll, and which is economical to produce. Moreover, the tube according to the present invention provides a carrier bag which, in relation to the first-mentioned prior art tube, has a considerably stronger central portion, where the handle of the carrier bag is most often located.

According to the invention, both of the material layers of the central portion of the tube are provided with alternating ribs and bands parallel to the longitudinal direction of the tube and located adjacent one another, each rib being of lesser width and greater thickness than each of the bands, and the sum total of the thicknesses of one rib and one band corresponding approximately to the total thickness of the four material layers of the edge portions.

The invention will be described in greater detail hereinbelow with reference to the accompanying drawing, on which;

Figure 1:
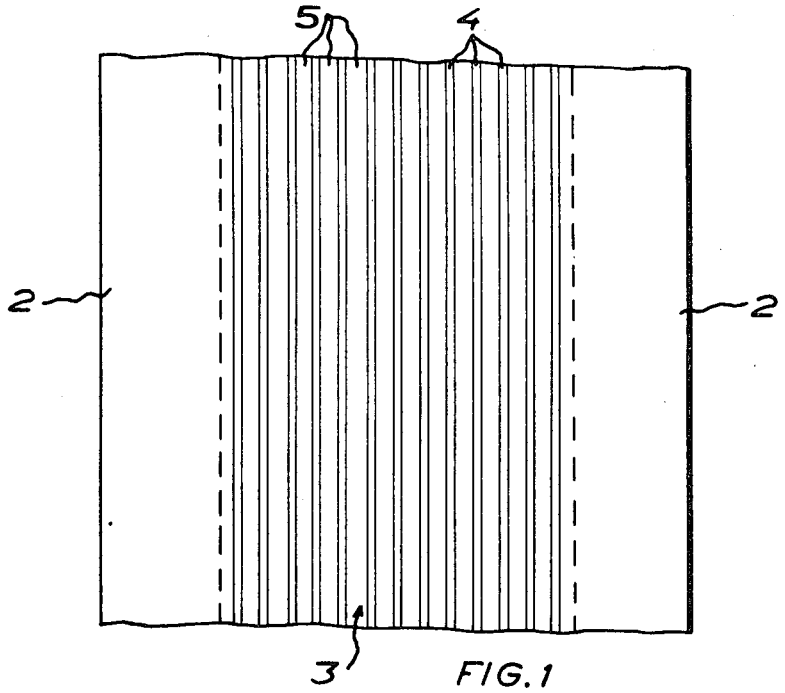
FIG. 1 shows a portion of a flatfolded tube according to the present invention.
Figure 2:
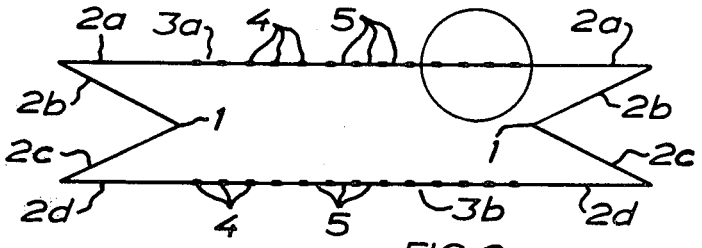
FIG. 2 is a cross-section of a tube according to FIG. 1 not completely folded.
Figure 3:
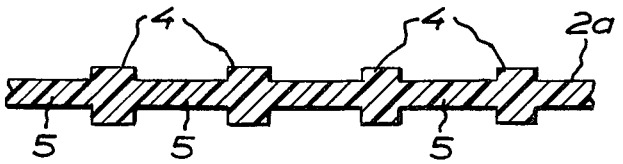
FIG. 3 shows the portion encircled in FIG. 2 on a larger scale.

The tube for the production of carrier bags with lateral accordion folds 1 according to the invention is manufactured of weldable plastic sheeting. In the flat-folded state, the tube has two edge portions 2 consisting of four substantially equally thick layers of material 2*a*, 2*b*, 2*c* and 2*d* produced by accordion-folding and located one over another, and a central portion 3 consisting of two layers of material 3*a* and 3*b* produced by the folding and located one over the other. Both of the material layers 3*a* and 3*b* are provided with alternating ribs and bands 5 parallel to the longitudinal direction of the tube and located adjacent one another. Each of the ribs is of lesser width and greater thickness than each of the bands 5 and the sum total of the thicknesses of one rib 4 and one band 5 corresponds approximately to the total thickness of the four material layers of the edge portions 2.

If, in the manufacture of the tube, the narrow ribs 4 of both of the material layers 3*a* and 3*b* are positioned in the manner shown in the embodiment according to the drawing, these ribs 4 will, upon folding, be mutually superposed. However, the probability that this will occur in practice is slight, since the material layers 3*a* and 3*b* shift somewhat in relation to each other upon folding. In order to reduce this slight probability even more, the distance between the narrow ribs 4 can be varied, which is the same as varying the width of the wide bands 5.

Thus, a tube according to the present invention provides, on being rolled up, a substantially even roll, since the sum total of the thicknesses of one narrow rib 4 and one wide band 5 corresponds approximately to the total thickness of the four material layers 2*a*, 2*b*, 2*c* and 2*d* of the edge portions 2. Furthermore, in comparison with a tube manufactured of material of uniform thickness but otherwise of similar dimensions to the tube according to the present invention, an increased strength will be obtained in the central portion 3 of the tube and consequently in the central portion of the carrier bag produced from the tube.

Moreover, a considerable saving of material will be obtained with the tube according to the present invention in comparison with a tube having a central portion in which the total thickness of the two material layers is equal to the total thickness of the four material layers of the edge portions.

In a preferred embodiment of the present invention, the four material layers 2*a*, 2*b*, 2*c* and 2*d* constituting the edge portion each have a thickness of 40 $\mu$m; the two material layers 3*a* and 3*b* constituting the central portion each have a thickness of 50 $\mu$m and the narrow ribs 4 have a thickness of 100 $\mu$m.

This latter tube yields a material saving of approximately 25% in comparison with a tube in which the thickness of all of the material layers is 60 $\mu$m, both of the tubes providing approximately the same carrying strength in the resultant carrier bags.

What I claim and desire to secure by Letters Patent is:

1. A tube of weldable sheeting for the production of carrier bags, comprising a. first and second tube wall portions, extending longitudinally of the tube in circumferentially spaced relationship, b. alternating ribs and bands extending longitudinally of the tube and forming together each of said first and second tube wall portions, each of said ribs being of lesser width and greater thickness than each of said bands, c. third and fourth tube wall portions, extending longitudinally of the tube and integrally connected to said first and second tube wall portions so as to form a tubular formation together with said first and second tube wall portions, said third and fourth tube wall portions having a thickness corresponding approximately to ½ of the sum total of the thicknesses of one of said ribs and one of said bands.

2. A tube as claimed in claim 1, wherein said ribs are approximately twice as thick as said bands.

3. A flat-folded tube of weldable sheeting for the production of carrier bags, having two edge portions formed by lateral accordion folds each of the edge portions comprising four layers of the sheeting, located over each other and substantially equal in thickness, and a central portion comprising two layers of the sheeting located one over the other between the two edge portions, comprising alternating ribs and bands extending longitudinally of the tube and forming together each of the layers of the central portion, each of said ribs being of lesser width and greater thickness than each of said bands, the sum total of the thicknesses of one rib and one band corresponding approximately to the total thickness of the four sheeting layers of the edge portions.

4. A flat-folded tube as claimed in claim 3, wherein said ribs are approximately twice as thick as said bands.

* * * * *